US005575379A

United States Patent [19]

Schmetzer

[11] Patent Number: 5,575,379

[45] Date of Patent: Nov. 19, 1996

[54] NEWSPAPER CONVEYOR

[75] Inventor: Helmut Schmetzer, Bayreuth, Germany

[73] Assignee: Gammerler Maschinenbau Und Anlagentechnik Gmbh, Geretsried-Gelting, Germany

[21] Appl. No.: 403,848

[22] PCT Filed: Jun. 17, 1994

[86] PCT No.: PCT/EP94/01983

§ 371 Date: Mar. 15, 1995

§ 102(e) Date: Mar. 15, 1995

[87] PCT Pub. No.: WO95/00429

PCT Pub. Date: Jan. 5, 1995

[30] Foreign Application Priority Data

Jun. 17, 1993 [DE] Germany ..... 43 20 085.0

[51] Int. Cl.[6] ..... B65G 47/86

[52] U.S. Cl. ..... 198/803.9; 198/803.7

[58] Field of Search ..... 198/470.1, 803.7, 198/803.9; 271/204, 277; 294/104, 99.1

[56] References Cited

U.S. PATENT DOCUMENTS

| | | | |
|---|---|---|---|
| 2,530,412 | 11/1950 | Wallace | 198/803.9 |
| 4,381,056 | 4/1983 | Eberle | 198/803.7 |
| 5,178,262 | 1/1993 | Merkli et al. | 198/803.9 |
| 5,360,101 | 11/1994 | Carlen | 198/803.7 |
| 5,388,820 | 2/1995 | Eberle et al. | 198/803.9 X |
| 5,395,151 | 3/1995 | Eberle | 198/803.9 X |

FOREIGN PATENT DOCUMENTS

| | | |
|---|---|---|
| 0243582 | 1/1987 | European Pat. Off. . |
| 0600183 | 10/1993 | European Pat. Off. . |
| 0886080 | 11/1981 | U.S.S.R. . |
| 2068892 | 8/1981 | United Kingdom . |

*Primary Examiner*—James R. Bidwell
*Attorney, Agent, or Firm*—Palmatier, Sjoquist & Helget, P.A.

[57] ABSTRACT

A newspaper conveyor has an endless conveyor chain (1) running along a conveyor (3) with a plurality of newspaper grips (7) in rows. Their movable clamp (11) may be set in two opening positions, a first one in which the movable clamp (11) is held open against the closing force of a spring (20) by a cam control curve (28) and a second in which the movable clamp (11) is self-lockingly held open by friction by the leaf spring (20).

17 Claims, 5 Drawing Sheets

NEWSPAPER CONVEYOR

BACKGROUND OF THE INVENTION

1. Field of the Invention

The invention relates to a newspaper conveyor.

2. Description of the Prior Art

Newspaper conveyors of this kind serve speedy transport of newspapers or parts thereof between various processing stations such as e.g. folding station, supplement insertion station and bundling station within a newspaper printing press. On such a newspaper conveyor a plurality of grips is employed for each newspaper at a time, with which the newspaper is transported along the corresponding conveyor, clamped between one fixed and one movable clamp each.

Various designs are known for the grips which from the point of view of design and actuating mechanism are all relatively complicated. For instance, designs are known which actuate the movable clamp by means of a complicated spiral spring mechanism which in the opening position of the movable clamp lock the latter in place. Furthermore, designs are on the market in which the movable clamp, in opening and closing, executes a swivel movement not only about one, but about two swivel axes located roughly at right angles to each other.

SUMMARY OF THE INVENTION

The object of the invention is to improve a newspaper conveyor of the kind specified as regards its grips so that they may be employed variably whilst reducing the complication in design.

This object is achieved by the features described in the following specification, according to which in employment of the grips, selection may be made between the two stated opening positions so that—if, for instance, only a brief opening of the grip is desired—it may be opened via a corresponding cam control curve only for a small period of time, to release the newspaper and subsequently move on to its closed position, but empty. If the movable clamp is required to remain open, it merely needs to be translated into the second opening position, in which it is held open self-lockingly by friction contact in a particularly simple design by means of a locking spring in the form of a leaf spring.

One especially advantageous embodiment of the subject matter described in the following specification. Due to the two-part configuration of the movable clamp and the relative swivelling action of the thereby created control part with respect to the clamp part a precise and speedy initiation of the opening movement of the clamp is possible. This is due to the control part being deflectable with the aid of a cam control curve on the conveyor without it having to initially work against the loading of the leaf spring producing the closing pressure. It is not until the maximum swivel angle of the control part is achieved with respect to the clamp part that the latter is moved together with the control part and translated into one of the opening positions against the pressure of the leaf spring. Accordingly, every newspaper grip can be opened with no problem and as wanted even in the case of conveyor chains running at very high speeds.

BRIEF DESCRIPTION OF THE DRAWINGS

Further features, details and advantages of the invention will be apparent from the remaining subclaims and the following description of the example embodiments of the subject matter of the invention with reference to the enclosed drawing, in which:

DESCRIPTION OF THE PREFERRED EMBODIMENTS

Figure 1:
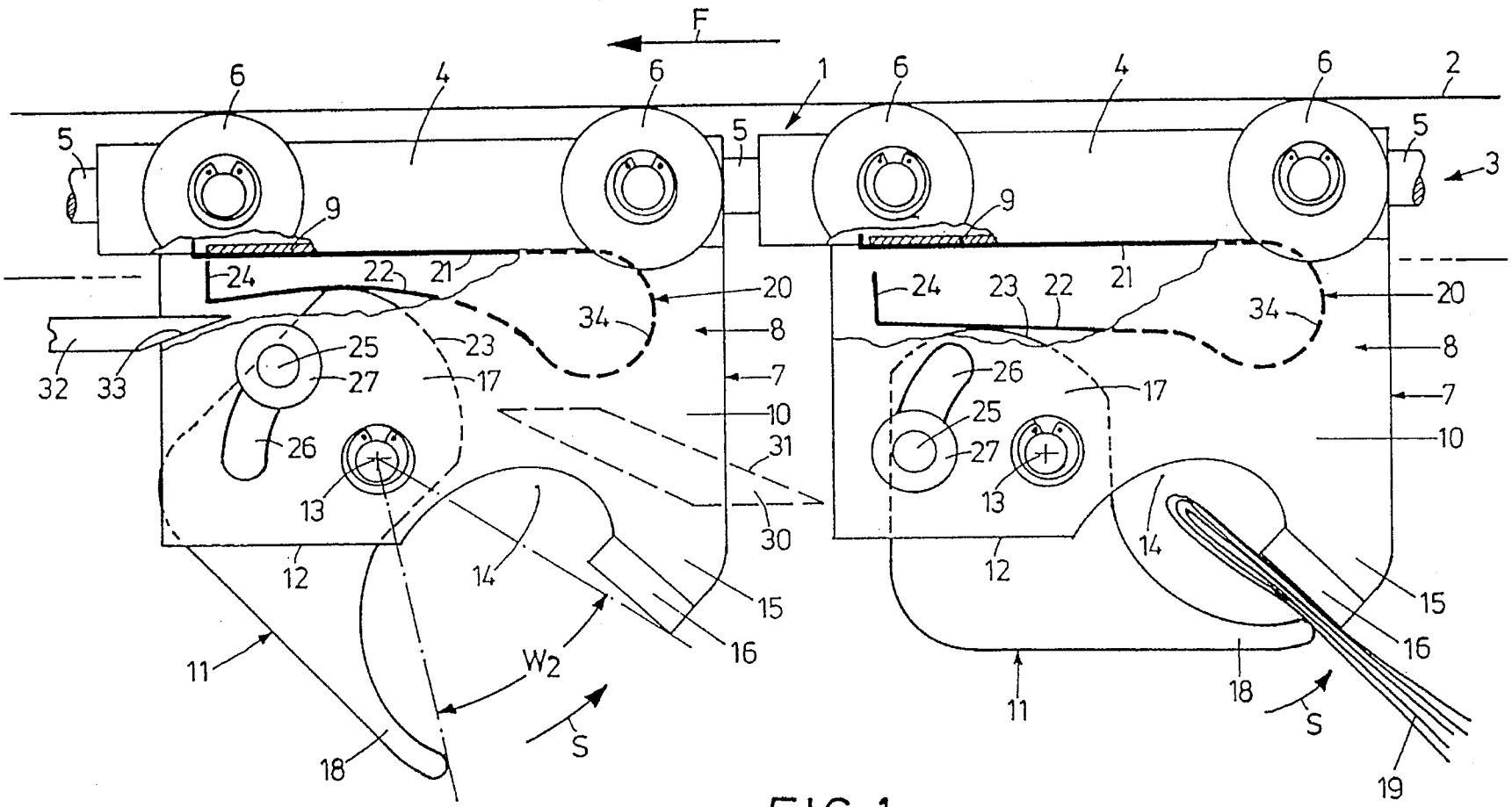
FIG. 1 is a schematic partial side view of a newspaper conveyor according to the invention having two grips shown in the closing position and in the self-lockingly held-open position.
Figure 2:
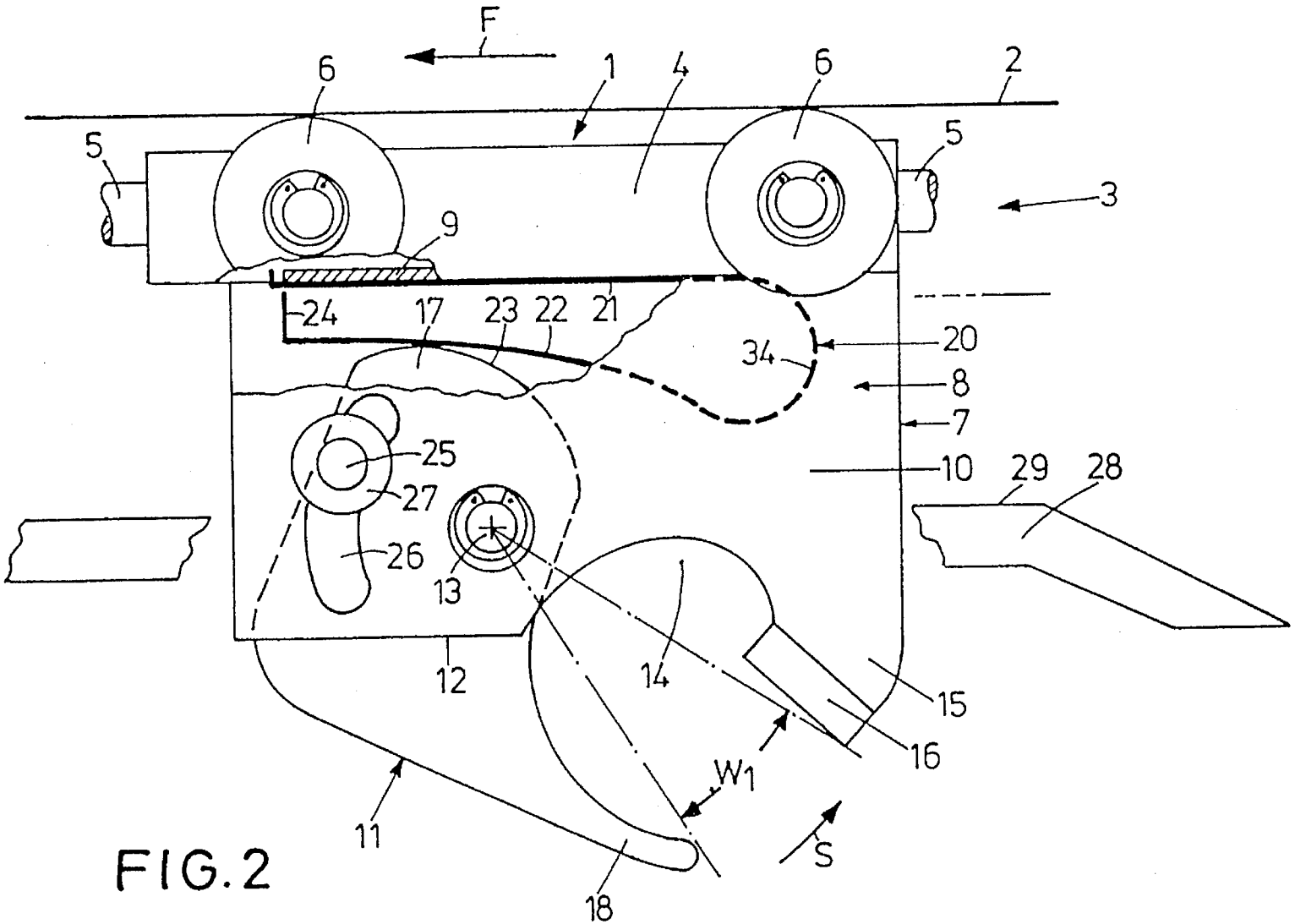
FIG. 2 is a schematic partial side view of a newspaper conveyor according to FIG. 1 showing the grip in a position of the movable clamp held-open by a cam control curve.

A newspaper conveyor according to the invention has in the embodiment as shown in FIGS. 1 and 2 an endless conveyor chain 1 running along a conveyor 3 comprising correspondingly section-shaped rails 2. The endless conveyor chain 1 comprises individually block-shaped chain links 4 which are connected articulatedly to each other by coupling members 5. The chain links 4 run on rollers 6 in the conveyor 3.

Disposed at chain link 4 of the endless conveyor chain 1 is a grip identified as a whole by 7, thus relative to the endless conveyor chain a plurality of such grips is arranged in a row relatively densely in the conveying direction F.

Each grip 7 has a supporting part 8 for securing the grip 7 to the chain link 4. It is configured as a curved part stamped from sheet metal having an essentially U-shaped cross-section, the base 9 of which is secured to the chain link 4. Between the cheeks 10, which are substantially rectangular in shape as viewed from the side and are in alignment in the conveying direction F, a movable clamp 11 is swivably mounted about a swivel axis 13 running transversely to the conveying direction F, roughly in the middle in front of the bottom edge 12 of the cheeks 10. On one side alongside the swivel axis 13 a recess 14 is provided in the two cheeks 10, each of which extends from the lower edge 12, roughly semi-circularly shaped. At the side of the recess 14 facing away from the swivel axis 13 the cheeks 10 each continue integrally by short, curved extension pieces 15, at the free ends of which the fixed clamp 16 is disposed, running transversely to the conveying direction F.

The movable clamp 11 is substantially configured L-shaped, its one leg being formed by the solid bearing part 17 receiving the swivel axis 13, the other leg by the grip arm 18. The fixed clamp 16 and the grip arm 18 of the movable clamp 11 coact, so that in the closing position shown in FIG. 1 on the basis of the right-hand grip 7 a newspaper 19 is held clamped between the two clamps 11, 16. To generate the clamping force the movable clamp 11 is urged by a leaf spring 20 in the closing direction S. The U-shaped curved leaf spring 20 is disposed in the supporting part 8 between the base 9 thereof and the bearing part 17 of the movable clamp 11. By its upper and lower leg 21, 22 the spring is supported by the base 9 of the supporting part 8 and the bearing portion 17 of the movable clamp 11 respectively, the bearing part 17 of the movable clamp 11 being provided on its upper side with a contact surface 23 curved convexly about a bending axis in parallel with the swivel axis 13 for the lower, second leg 22 of the leaf spring 20. Via this contact surface 23 a torque is generated in the closing direction S at the movable clamp 11 by the second, lower leg 22 of the leaf spring 20, thus resulting in the aforementioned clamping force.

Furthermore, the lower leg 22 of the leaf spring 20 is provided at its end with a stopper land 24 facing the first leg 21, the function of which is later described in more detail. Projecting transversely to the conveying direction F, spaced away from its swivel axis 13, the movable clamp 11 itself features a pin 25 which protrudes through a curved slot 26 in the cheek 10 of the supporting part 1. At the free end of the pin 25 a roller 27 is secured. Pin 25 and roller 27 form a cam follower for the cam control curves to be described in more detail on the conveyor, by means of which the closing and opening movement of the movable clamp 11 is controllable. This functions as follows:

Starting from the closing position, shown on the right in FIG. 1, of grip 7 the movable clamp 11 of the latter may be disposed by means of the ramp-like cam control curve 28 illustrated schematically in FIG. 2 into the first opening position shown in this Figure, in which the movable clamp 11 is maintained open against the closing force of the leaf spring 20 by means a continuous support due to the horizontal part 29 (depicted broken away in FIG. 2 for the sake of added clarity) of the cam control curve 28. As soon as the support offered by the cam control curve 28 is discontinued, the movable clamp 11 automatically closes under the influence of the leaf spring 20.

As an alternative, the movable clamp 11 may be disposed into a second opening position as shown on the left in FIG. 1. In this second opening position the movable clamp 11 is self-lockingly held open by the friction contact of its contact surface 23 with the second leg 22 of the leaf spring 20. To translate the movable clamp 11 into this second opening position a cam control curve 30, shown dashed in FIG. 1, having a higher ramp 31 than that of cam control surve 28 is necessary. Accordingly, in the first opening position shown in FIG. 2 the opening angle W1 is also smaller than the opening angle W2 in the second opening position shown on the left in FIG. 1.

In translating the movable clamp 11 from the first closing position (on the right in FIG. 1) into the second opening position (on the left in FIG. 1) the second leg 22 of the leaf spring 20 comes up against the first leg 21 by its stopper land 24. This occurs more or less at an opening angle W1 as is shown in FIG. 2. In further swivelling of the movable clamp 16 the second leg 22 of the leaf spring 20 is inherently elastically deformable, resulting in the friction contact between the contact surface 23 and this leg 22 being increased to such a degree that due to the friction contact a self-locking action of the movable clamp 11 in the second opening position shown on the left in FIG. 1 occurs. Accordingly, no further support by the cam control curve 30 is needed to maintain this opening position.

If, starting from this opening position, the movable clamp 11 is required to be translated back into its closing position, a separate cam control curve 32 having a ramp oriented in the opposite direction is necessary, by means of which the friction contact between the contact surface of the movable clamp 11 and the leg 22 of the leaf spring 20 is rediscontinued and subsequently the clamp 11 is automatically returned into the closing position, as shown on the right in FIG. 1, by the action of the leaf spring 20.

It is to be noted that the curvature of the contact surface 23 relative to the swivel axis 13 is configured in such a way that as the angle of the movable clamp 11 increases, the second leg 22 of the leaf spring 20 is flexed increasingly in the direction of the first leg 21, resulting in the force generated by the leaf spring being increased at the movable clamp. At the same time, in translation of the clamp 11 particularly into the second opening position, the substantially line-shaped contact area of the contact surface 23 of the movable clamp 11 on the second leg 21 of the leaf spring 20 wanders in the direction of the base 34 of the leaf spring 20, thus shortening the leverage with which the leaf spring 20 acts on the clamp 11. Since, in addition to this, the side deflection of the line of action of the force translated from the leaf spring 20 to the clamp 11 is at a minimum with respect to the swivel axis 13 in this position, the friction contact between clamp 11 and leaf spring 20 is sufficient to maintain the clamp 11 in the opening position as shown on the left in FIG. 1.

The second embodiment of a newspaper conveyor according to the invention as shown in FIGS. 3 to 11 is provided in turn with individual newspaper grips 7' which form a row on an endless conveyor chain, the same as shown in FIGS. 1 and 2, and are driven in the conveying direction F. The supporting part 8' and the leaf spring 20' are substantially the same as the corresponding components of the example embodiment as shown in FIGS. 1 and 2 and thus do not need to be again explained. Also, further components of the second embodiment having the same functions as the corresponding components of the first embodiment are identified by the same reference numerals with the addition of an apostrophe.

However, unlike the configuration of the example embodiment shown in FIGS. 1 and 2 the movable clamp 11' is formed two-part and comprises the actual clamp part 35 and a control part 36. The clamp part 35 corresponds by its outer shape to that of clamp 11 of the example embodiment shown in FIGS. 1 and 2 and thus has a bearing part 17' which is mounted to swivel about a swivel axis 13' located in its axis hole **39*a* between the two cheeks 10' of the supporting part 8'. The continuation of bearing part 17' is the grip arm 18' at the free end of which side elongations 37 are provided. In addition, the bearing part 17' of the clamp part 35 is provided with a recess 38 oriented in its swivelling plane SE (FIG. 8), centrally located in the direction of the leaf spring 20 and open at the side, in which the control part 36 configured as a block is arranged and which is also mounted to swivel about the swivel axis 13' on the clamp part 35 by means of an axis hole 39** oriented transversely to the conveying direction F.

In this arrangement the axis holes 39, **39*a* are located in the corner region of the bearing part 17' and the control part 36 respectively facing the grip arm 18', in the diametrally opposed edge area the control part 36 being provided with a pin 25' protruding sideways transversely to the conveying direction F which may be arranged alternatively to face the left or right as regards the conveying direction F. This pin 25' protrudes through a curved slot 40, one of which is arranged in each of the two side cheek 41, 42 of the clamp part 35 defining the recess 38** in a position in line with each other.

The apex of curvature of the two slots 40 is located in the swivel axis 13'. The end 43 of the slots 40 facing clockwise with respect to FIGS. 3 to 6 defines the swivel angle between the control part 36 and the clamp part 35. In the opposite direction the swivel angle is defined by the underside 45 of the control part 36 coming into contact with the bottom 44 of the recess 38. In this arrangement too, the pin 25' protrudes through the slot 26' in the side cheeks 10' of the supporting part 8', said slot coinciding with the slot 40. By their apex of curvature the slots 26' are also located on the swivel axis 13' and cover a 90° angle of extension.

Alternatively from the left or right, the pin 25' acting as a follower with regard to the cam control curve employed may be screwed into a corresponding threaded hole oriented transversely to the conveying direction F running through the control part 36 and thus the position of the pin 25' may be adapted to customer requirements in each case. For instance, the pins of the newspaper grips 7, 7' may be fitted in an endless conveyor chain 1 so that they only protrude on the left, resulting in all newspaper grips being opened by a cam control curve arranged on the left of the conveyor 3. If the pins 25' are fitted protruding alternately left and right in a sequence of newspaper grips 7, 7', only every second newspaper grip 7, 7' is opened by a cam control curve arranged on the left of the conveyor 3. The newspaper grips 7, 7' provided with a pin 25' protruding to the right may then be opened subsequently at another position on the conveyor 3.

Just as well, only every third newspaper grip may be opened by a corresponding arrangement of pins 25' disposed to the left and right at a position on the conveyor, a subsequent change to the opening action in the region of a cam control curve also being possible by a reassembly of the pins 25'.

The control part 36 is spring-loaded in the closing direction S relative to the clamp part 35, a spiral compression spring 46 being inserted for this purpose into two blind holes 47, 48 in the control part 36 and the clamp part 35 respectively, located on the underside 45 of the control part 36 and in the bottom 44 of the recess 38 of the clamp part 35 respectively, having openings merging into each other. In this arrangement the blind hole 47 in the control part 36 is disposed in the region between the swivel axis 13' and the side surface 49 of the control part 36 facing the fixed clamp 16'.

Figure 3:
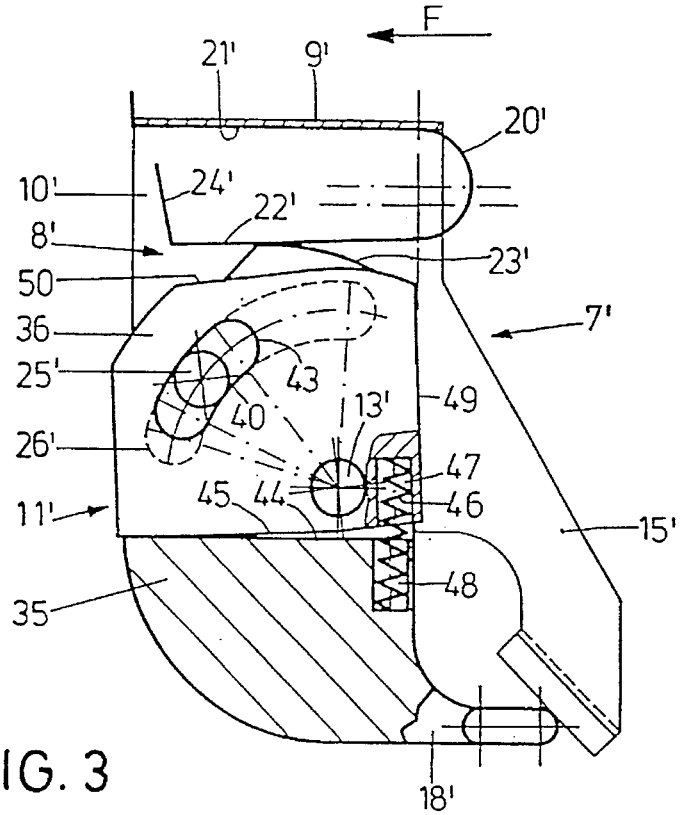
FIG. 3 to FIG. 6 are sections disposed in the swivel plane of the movable clamp through the grips of a second embodiment shown in the closing position and in various opening positions.

The functioning of the newspaper grip 7' illustrated in FIGS. 5 to 11 is represented as follows:

In FIG. 3 the clamp part 35 is shown in its closed position which is maintained by its contact surface 23' being subjected to the force of the leaf spring 20', the control part 36 being in contact by its underside 45 with the bottom 44 of the recess 38 due to the influence of the spiral compression spring 46.

When the newspaper grip negotiates a cam control curve (not shown in FIGS. 3 to 6) the latter detects the pin 25' serving as the cam follower and deflects the control part 36 smoothly—since it is merely required to work against the relatively weak spiral compression spring 46—until the pin 25' comes up against the end 43 of the slot 40 in the clamp part 35. With further lifting of the pin 25' as dictated by the cam control curve the clamp part 35 is opened contrary to the closing direction and against the force exerted by the leaf spring 20'. Due to a relatively slight swivel action of the control part 36 into the first opening position analogous to the example embodiment as depicted in FIGS. 1 and 2 the clamp part is maintained in the opening position non-self-lockingly by its contact surface 23'. Once the cam control curve 28 loses contact, the clamp part is reclosed by the influence of the leaf spring 20'.

Figure 4:
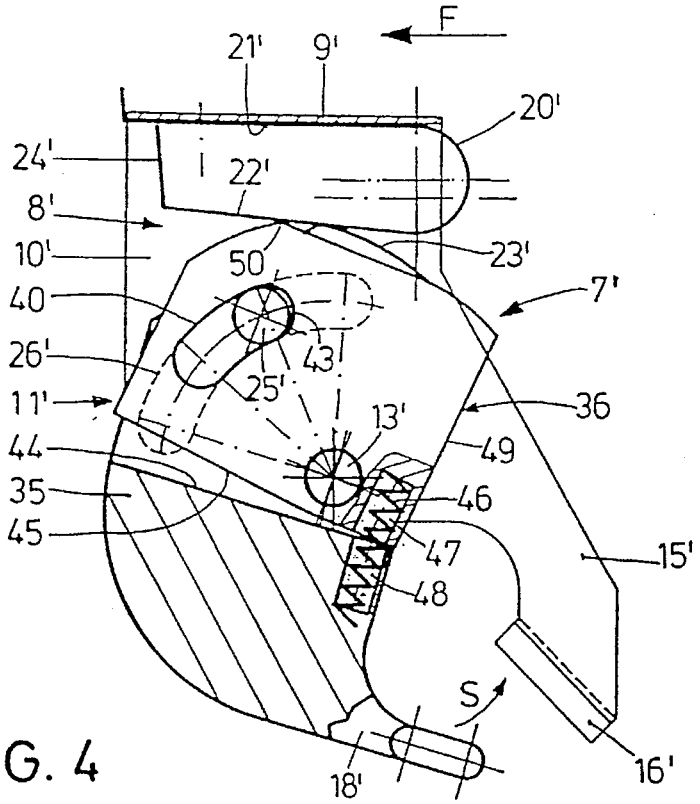
Figure 5:
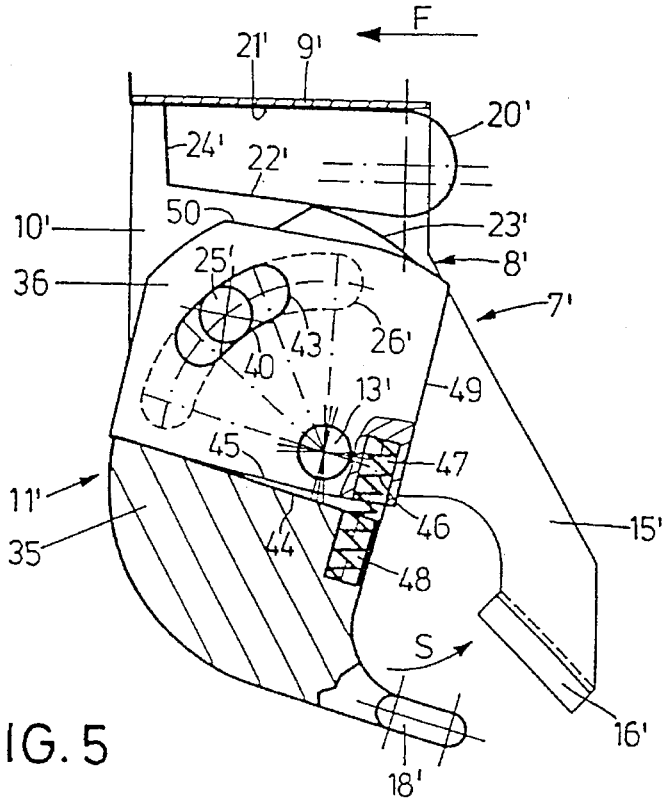

When the control part 36 is deflected more strongly as a result of the cam control curve being configured accordingly, the clamp part 35 is swivelled to such an extent that it attains the second opening position analogous to the example embodiment depicted in FIGS. 1 and 2 and is maintained self-lockingly by friction contact with the leaf spring 20' (FIG. 4). As soon as the cam control curve 30 loses contact the clamp part 35 is retained in the second opening position, the control part 36 being able to swivel back into its starting position with contact between its underside 45 and the bottom 44 due to the influence of the spiral compression spring 46. To translate the clamp part 35 into its closing position a cam control curve acting correspondingly inversely needs to be provided.

If as a result of the configuration of the cam control curve the control part 36 and thus the clamp part 35 are swivelled past the second opening position further into a third opening position (FIG. 6), the contact surface 50 provided on the upper side of the control part 36 deforms the leaf spring 20' to such an extent that the contact surface 23' of the clamp part 35 loses contact. In this third opening position the control part 36 is maintained open self-lockingly by the friction contact with the leaf spring 20'. The clamp part 35 is swivable relative to the control part 36 by the swivel angle defined between these two components in the closing direction S against the force exerted by the spiral compression spring 46. This embodiment is of advantage when the newspaper grip flies over a shingled layer of newspapers located beneath in the conveying direction F and, for example in the case of very thick newspapers, the grip arm 18' comes into contact with the newspapers. Due to it being capable of swivel action in the third opening position it is able to respond pliantly so as not to mess up the shingled layer.

Figure 6:
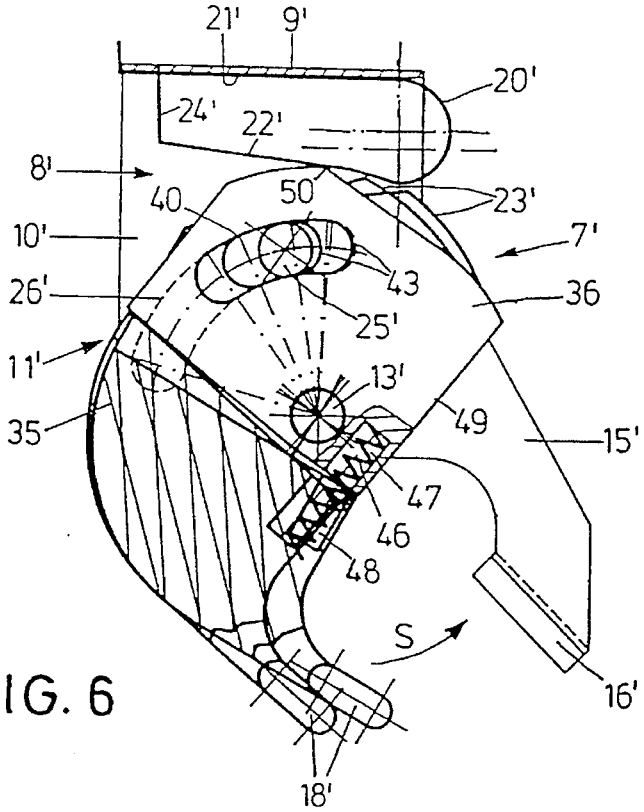
Figure 7:
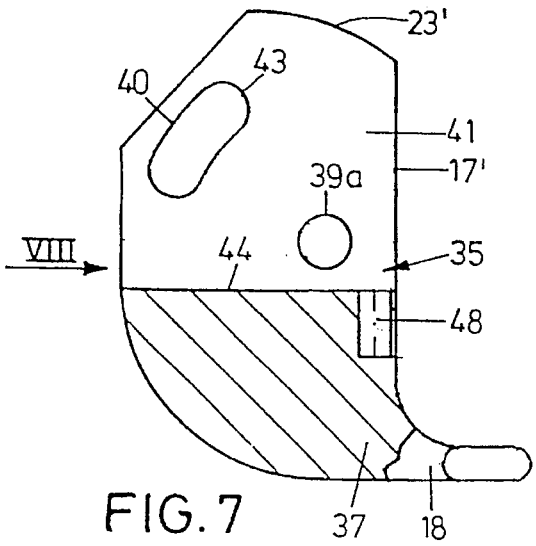
FIG. 7 is a section through a clamp part of the newspaper grip as shown in FIGS. 3 to 6 disposed in the swivel plane.
Figure 8:
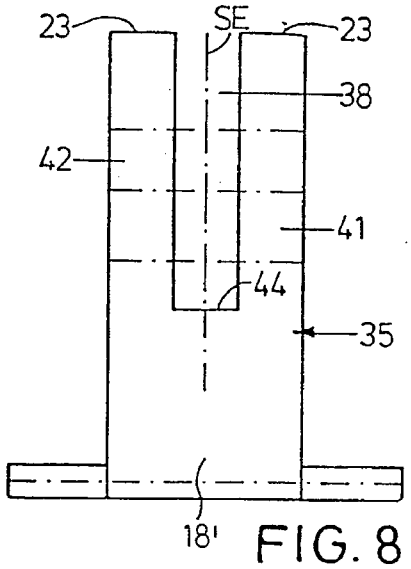
FIG.8 is a view of the clamp part in the direction of the arrow VIII as shown in FIG. 7.
Figure 9:
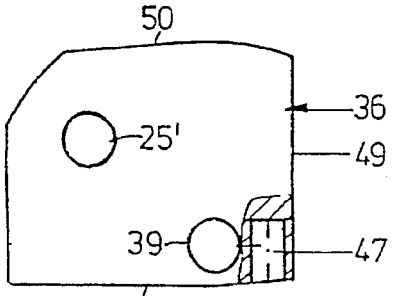
FIG. 9 is a partially sectioned side view of a control part of the newspaper grip as shown in FIGS. 3 to 6.
Figure 10:
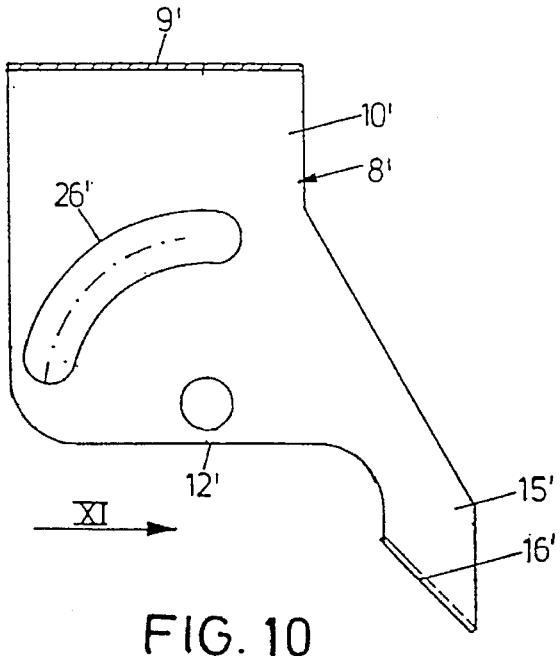
FIG. 10 is a section through a supporting part of the newspaper grip as shown in FIGS. 3 to 6 disposed in the swivel plane.
Figure 11:
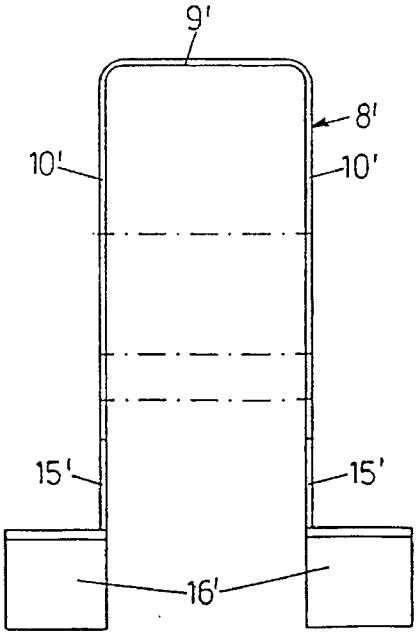
FIG. 11 is a view of the supporting part in the direction of the arrow XI as shown in FIG. 10.

The clamp part 35 can be made to leave the third opening position as shown in FIG. 6 by a corresponding cam control curve which senses the control part 36 via the pin 25' and urges the latter together with the clamp part 35 under the influence of the leaf spring 20' into the closing position (FIG. 3).

In conclusion, it is to be noted that by providing an alternating orientation of pins 25' in a sequence of newspaper grips 7' to the left or right with respect to the conveying direction F and by locating cam control curves correspondingly on one side only every second newspaper grip may be selectively opened.

I claim:

1. A newspaper conveyor having an endless conveyor chain (1) running along a conveyor (3) and a plurality of newspaper grips (7, 7') arranged in sequence thereon, each of which has a supporting part (8, 8') for securing said grip (7, 7') to said endless conveyor chain (1), a fixed clamp (16, 16') and a movable clamp (11, 11') coacting therewith by the action of a spring (leaf spring 20, 20'), between said clamps (11, 11', 16, 16') when said movable clamps (11, 11') are closed a newspaper is clampable, the closing and opening movement of said movable clamp (11, 11') being controllable via cam control curves (28, 30, 32) on said conveyor (3) characterized in that said movable clamp (11) is adjustable in two opening positions, namely a first opening position in which said movable clamp (11, 11') is maintained open by a cam control curve (28) against the closing force of said spring in the form of a leaf spring (20, 20') and a second opening position in which said movable clamp (11,

11') is maintained open self-lockingly by friction contact with said leaf spring (20, 20').

2. The newspaper conveyor as set forth in claim 1 characterized in that said supporting part (8, 8') is configured essentially U-shaped in cross-section, the base (9, 9') of which is secured to said endless conveyor chain (1) and between the cheeks (10, 10') of which said movable clamp (11, 11') is swivably mounted about a swivel axis (13, 13') running transversely to the conveying direction (F).

3. The newspaper conveyor as set forth in claim 2 characterized in that said leaf spring (20, 20') disposed in said supporting part (8, 8') between the base (9, 9') thereof and a bearing part (17, 17') of said movable clamp (11, 11') is curved U-shaped and is supported by a first leg (21, 21') on the base (9, 9') of said supporting part (8, 8') and by a second leg (22, 22') at least on said bearing part (17, 17') of said movable clamp (11, 11').

4. The newspaper conveyor as set forth in claim 3 characterized in that said bearing part (17, 17') of said movable clamp (11, 11') is provided with a contact surface (23, 23') curved convexly about a bending axis in parallel with said swivel axis (13, 13') for said second leg (22, 22') of said leaf spring (20, 20').

5. The newspaper conveyor as set forth in claim 4 characterized in that the curvature of said contact surface (23, 23') is configured relative to said swivel axis (13, 13') such that with increasing angle of opening of said movable clamp (16, 16') said second leg (22, 22') of said leaf spring (20, 20') is flexed increasingly in the direction of said first leg (21, 21').

6. The newspaper conveyor as set forth in claim 3 characterized in that said second leg (22, 22') of said leaf spring (20, 20') has at its end a stopper land (24, 24') facing towards said first leg (21, 21').

7. The newspaper conveyor as set forth claim 1 characterized in that the angle of opening (W1) of said movable clamp (11, 11') in the first opening position is smaller than its angle of opening (W2) in the second opening position.

8. The newspaper conveyor as set forth in claim 6 or 7 characterized in that said second leg (22, 22')of said leaf spring (20, 20') is inherently elastically deformable in translating said movable clamp (11,11')from said first into said second opening position with said stopper land (24, 24') coming up against said first leg (21, 21') to increase the friction between contact surface (23, 23') and said second leg (22, 22').

9. The newspaper conveyor as set forth in claim 8 characterized in that the contact area of said contact surface (23, 23') of said movable clamp (11, 11') on said second leg (22, 22') of said leaf spring (20, 20') wanders in the direction of said base (34, 34') of said leaf spring (20, 20') in translating said clamp (11, 11') into said second opening position.

10. The newspaper conveyor as set forth in claim 2 characterized in that for said cam control curve (28, 30, 32) said movable clamp (11, 11') is provided transversely to the conveying direction (F) with a cam follower (pin 25, 25', roller 27) which protrudes through a curved slot (26, 26') in at least one of the cheeks (10, 10') of said supporting part (8, 8').

11. The newspaper conveyor as set forth in claim 1 characterized in that said movable clamp (11') is formed two-part and features a clamp part (35) and a control part (36) which on said clamp part (35) is swivably mounted relative to the latter about a defined swivel angle in the opening or closing direction of said clamp part (35), which is spring-loaded (spiral compression spring 46) in the closing direction (S) of said clamp part (35) and which is engaged by a cam control curve for translating said clamp part (35) into the opening positions.

12. The newspaper conveyor as set forth in claim 11 characterized in that said control part (36) and said clamp part (35) are swivably mounted about a common swivel axis (13') in said supporting part (8').

13. The newspaper conveyor as set forth in claim 11 or 12 characterized in that said movable clamp (11') is translatable via a cam control curve into a third opening position in which said control part (36) is maintained open self-lockingly by friction contact with said leaf spring (20') and in which said clamp part (35) is swivable relative to said control part (36) about the defined relative swivel angle in the closing direction (S).

14. The newspaper conveyor as set forth in claim 11 characterized in that said bearing part (17') of said clamp part (35') is provided with a recess (38) oriented centrally in its swivelling plane (SE), open at least in the direction of said leaf spring (20'), in which said control part (36) is arranged in the form of a block.

15. The newspaper conveyor as set forth in claim 14 characterized in that said control part (36) is provided with a cam follower (pin 25') projecting in the conveying direction (F) which protrudes through one of the side cheeks (41, 42) of said clamp part (35) defining said recess (38) and through the cheeks (10') of said supporting part (8') via a separate slot (slot 40, 26') each.

16. The newspaper conveyor as set forth in claim 14 or 15 characterized in that for spring-loading said control part (36) relative to said clamp part (35) a spiral compression spring (46) is inserted in two blind holes (47, 48) which are disposed on the underside (45) of said control part (36) and in the bottom (44) of said recess (38) of said clamp part (35) with openings merging into each other.

17. The newspaper conveyor as set forth in claim 10 or 15 characterized in that said cam follower (pin 25, 25', roller 27) is releasably secured to said movable clamp (11, 11') or to said control part (36) and is mountable to protrude either to the left or right transversely to the conveying direction (F).

* * * * *